United States Patent [19]

Francis et al.

[11] 4,117,589

[45] Oct. 3, 1978

[54] METHOD OF MANUFACTURING A HERMETICALLY SEALED ELECTRONIC COMPONENT

[75] Inventors: Gaylord Lee Francis, Califon; Amedeo John Morelli, Randolph, both of N.J.

[73] Assignee: North American Philips Corporation, New York, N.Y.

[21] Appl. No.: 774,136

[22] Filed: Mar. 3, 1977

Related U.S. Application Data

[63] Continuation-in-part of Ser. No. 616,651, Sep. 25, 1975, Pat. No. 4,016,527.

[51] Int. Cl.[2] ..... H01C 17/28

[52] U.S. Cl. ..... 29/619; 29/620; 29/628; 174/52 S; 228/250; 228/263; 338/274; 338/276; 338/323; 338/329; 357/73; 361/308

[58] Field of Search ..... 29/628, 620, 613, 619, 29/621; 228/263, 250, 245, 227, 225, 187, 179, 180, 212; 174/52 S, 50.61; 338/273, 274, 276, 322, 323, 329, 332; 357/72, 73; 361/308, 309, 310

[56] References Cited

U.S. PATENT DOCUMENTS

| | | | |
|---|---|---|---|
| 2,489,409 | 11/1949 | Green et al. | 29/619 X |
| 2,987,813 | 6/1961 | Pope et al. | 338/274 UX |
| 3,037,266 | 6/1962 | Pfister | 29/619 X |
| 3,205,562 | 9/1965 | Karalis et al. | 29/620 X |
| 3,244,559 | 4/1966 | Sivertsen et al. | 427/103 X |
| 3,307,134 | 2/1967 | Griest | 29/628 |
| 3,458,783 | 7/1969 | Rosenberg | 338/274 X |
| 3,810,068 | 5/1974 | DeLuca | 29/619 X |
| 4,010,440 | 3/1977 | Wellard | 29/619 X |

*Primary Examiner*—Victor A. DiPalma
*Attorney, Agent, or Firm*—Frank R. Trifari; Daniel R. McGlynn

[57] ABSTRACT

A method of manufacturing a passive hermetically sealed electronic component having a coupling element of soft alloy material between the component element and the leads for providing strain relief. The component element is composed of a passive element having coated ends composed of a refractory metallic material for providing reliable electrical and mechanical connection to the coupling element.

14 Claims, 4 Drawing Figures

Fig 1
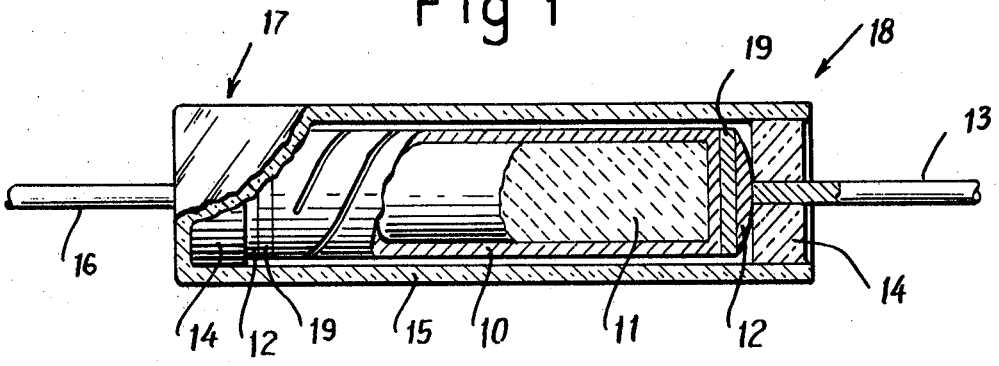
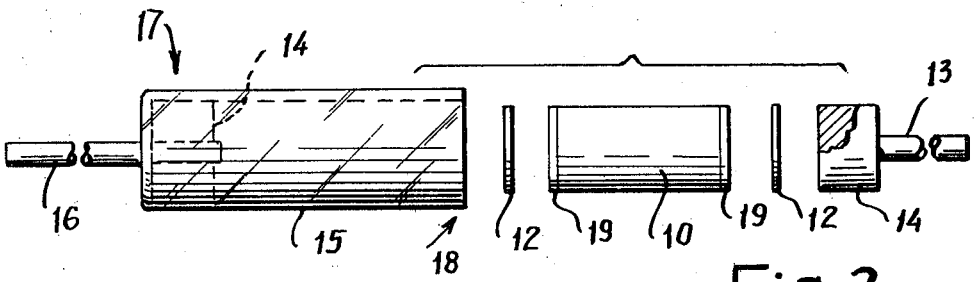
Fig. 2.
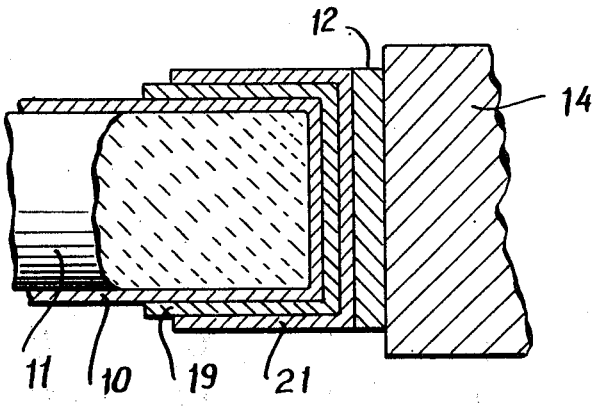
Fig. 3.
Fig. 4.
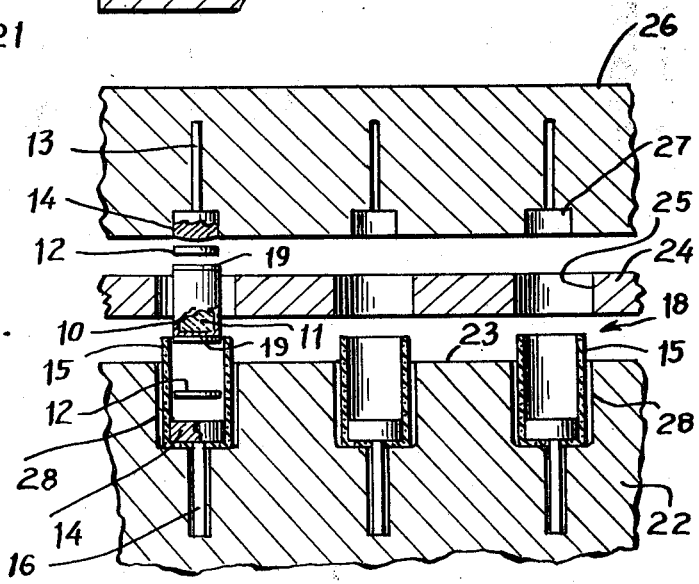

METHOD OF MANUFACTURING A HERMETICALLY SEALED ELECTRONIC COMPONENT

REFERENCE TO RELATED APPLICATIONS

This is a continuation-in-part of U.S. patent application Ser. No. 616,651, filed Sept. 25, 1975, now U.S. Pat. No. 4,016,527.

BACKGROUND OF THE INVENTION

The invention relates to the manufacture of electronic components, particularly hermetically sealed passive components, and further relates to the application of end coatings to such components during manufacture.

Hermetically sealed electronic components are known for active components such as diodes, and capacitors such as in U.S. Pat. No. 3,458,783. Such components are utilized in hostile environments which could affect the performance characteristics of such components.

U.S. Pat. Nos. 3,810,068 and 3,307,134 describe prior art versions of a hermetically sealed impedence element. Such prior art components utilize ceramic frits or cermets to form the electrical and mechanical connection between the resistive element and the leads. Such connections may be disadvantageous in certain high reliability applications. Furthermore, the use of a magnesium reaction terminal requires a different manufacturing process than is widely used in the industry.

Molybdenum-mangannese alloy is also known to be used on ceramic substrates, but not in connection with hermetically sealed components, or the method of manufacturing such components.

SUMMARY OF THE INVENTION

It is an object of the invention to provide a method of manufacturing a hermetically sealed component.

It is another object of the invention to provide an electronic component having a solderable refractory material as a metal end coating.

It is yet another object of the invention to provide a hermetically sealed electronic component that utilizes proven technology for forming electrical and mechanical connections to the component element.

It is still another object of the invention to provide a coupling element between an electrical component in a hermetically sealed container which provides strain relief from the differential shrinking between the container and the resistance element at different temperatures.

The present invention provides a method of manufacturing a hermetically sealed electrical device, including the steps of:

providing an electrical core element having terminals at opposed ends;

coating said terminals with a refractory metal coating;

surrounding said component with a hermetically sealable enclosure, having leads connectable with said terminals; and sealing said enclosure.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawings.

BRIEF DESCRIPTION OF THE DRAWINGS

FIG. 1 is a cutaway cross-sectional view of a hermetically sealed resistor manufactured according to the present invention;

FIG. 2 is an exploded view of the resistor shown in FIG. 1;

FIG. 3 is a cross-sectional view of a portion of another embodiment of the invention showing the use of a barrier layer; and FIG. 4 shows the arrangement of a locator plate, heater plate, and boat for manufacturing the hermetically sealed component according to the present invention.

DESCRIPTION OF THE PREFERRED EMBODIMENTS

Referring now to FIG. 1, there is shown a cross-sectional view of a hermetically sealed passive component according to the present invention. In one embodiment of the invention, the component is a film resistor, formed by a resistive element consisting of a film 10 coated on the entire surface of a solid cylindrical core 11.

The core 11 is composed of a Fosterite ceramic or other high expansion ceramic in the range of 8.5–10.5 ppm per ° C.

The ends of the component 10, 11 are coated with a metallic end coating 19. A solder or braze metal alloy preform 12 is provided adjacent to the two ends of the element for making an electrical and mechanical connection between the end coating 19 of the element 10, 11 and the leads 13, 16.

FIG. 2 is an exploded view of the component shown in FIG. 1, and more clearly indicates the metallic end coating 19, and preforms 12. The preform 12 is selected to have an appropriate melting point consistent with the manufacturing process.

Flexible copperclad steel leads 13 and 16 are provided which extend axially from the element 10, 11. Lead 13 is shown attached to an enlarged stud or head 14 which makes electrical contact with the resistive element through the preform 12. The head 14 may comprise a glass bead for forming a fused glass seal of the electrical component (a "beaded lead") or could be a Dumet slug with expansion coefficients which is compatible with the glass. (Dumet is a copperclad nickel-steel alloy) (a "studded lead").

The studded lead 13 is made by cutting a Dumet wire coated with a borate compound to a predetermined length to form the head 14, and welding a copper-clad steel wire 13 to one end. It is also possible to utilize a heavily oxidized Dumet wire for certain applications. By pretreating the Dumet wire in this fashion a good heat seal of the head 14 to the glass bottle 15 is made possible when heat sealing the glass bottle 15. The lead-wire 13 should protrude into the interior of the glass bottle by 0.000 to 0.020 in. preferably about 0.005 in., for making electrical connection with the solder preform 12.

The element 10, 11, preforms 12 and head 14 are encapsulated entirely within a glass tube or bottle 15. The embodiment of a glass bottle 15 is shown in FIG. 2. A glass bottle 15 is defined as a glass cylinder having one end closed in an air-tight seal. A copper clad steel lead 16 is heat-sealed to the closed end 17 of the bottle 15 prior to assembly with the lead 16 protruding into the interior of the bottle 15 for making electrical contact with the preform 12. The preform is first inserted into the bottle by automatically aligning a batch of preforms over a carbon boat, the boat containing an array of bottles, so that a single preform drops to the bottom of each bottle in the boat. The components are also inserted in a similar manner, as illustrated in FIG. 4. After the solder preform 12, the core component 10, preform 12, and head 14 of lead 13 are inserted into the bottle 15, the open end 18 of the bottle 15 is heat-sealed, thereby forming an air-tight enclosure of the resistive element within the bottle 15.

The resistive core 11 consists of a refractory material which is compatible in terms of the temperature coefficient of linear expansion with the glass tube or bottle 15.

The core 11 is preferably composed of a Fosterite ceramic or other high expansion ceramic in the range of 8.8–10.5 ppm per ° C.

The resistive film 10 refers to an electrically conductive film (a cermet, or thin metal film, such as a chromium-nickel composition) with predetermined resistive properties, which completely covers the core 11, and then may be cut or spiralled to a particular resistive value by known techniques in the art of film resistors. The film may also be left without cutting or spiralling to be formed after assembly of the device. The specific composition of the resistive film is selected so that the characteristics of the film are consistent with the assembly process for the device. A low-resistive metallic coating 19 is deposited on the ends of the resistive element 10, 11 over the resistive film 10, and may overlap the sides by approximately 0.002 to 0.020 inches. This metallic end coating 19 must also be compatible with the resistive film 10 in terms of heat-expansive properties, i.e., have a suitable temperature coefficients of linear expansion.

Many end coating materials which are solderable react with the resistive film at the heat-sealing temperature of the glass, or react slowly at elevated temperatures causing some drift in the resistive properties or electrical characteristics of the electronic component as a function of temperature and time. Examples of such unsuitable coating materials are copper and silver. The drift in electrical characteristics is highly undesirable for precision electronic components.

The use of "refractory" metals as defined herein includes nickel, cobalt, chrome, molybdenum, tungsten, tantalum, titanium and aluminum; the use of such refractory metals as an end coating material has been found to provide more satisfactory results. Nickel is preferred because of its readiness to solder or braze without flux, its relatively low resistivity, as well as being convenient to work with. Any alloy of one or more of the above refractory metals may also be used. When using silver, copper, or gold over the end portion of the resistive film 10, it is desirable to use a "barrier layer" over the resistive film under the gold, silver or copper layer. The term "barrier layer" refers to the possibility that the refractory end coating barrier material may extend beyond the silver or gold coating into the resistive film 10 itself. The barrier layer acts as a barrier to the diffusion of more active atoms of silver, copper gold into the resistive film 10.

FIG. 3 is a cross-sectional representation of a resistor having a barrier layer 19 over the resistive film 10. On top of the barrier layer 19 is a gold, silver, or copper end termination 21 which makes electrical and mechanical connection to the solder preform 12 and head 14 of the terminal. As shown in the Figure, the barrier layer 19 extends further along the resistive film 10 than the end termination 21, thereby preventing the diffusion of the active atoms of the end termination 21 into the resistive film 10.

Various tests of components using specific elements as end-coatings materials were made at specific temperatures and over long periods of time (e.g. 165 hours at 185° C.). These tests specifically utilized metal film resistors with a rated wattage of 0.1 watts: a 650Ω resistor with a copper end-coating; a 150Ω resistor with a molybdenum-silver end-coating (i.e., a molybdenum barrier layer, with silver end-coating thereover); and 150Ω resistor with a nickel end-coating. Resistive readings were taken before and after the heat aging process, and the percentage change in resistive value of the resistor due to the heat aging process were calculated. The results of these tests on the three types of resistors are shown in the table below:

| | COPPER END-COATING | MOLY-SILVER END-COATING | NICKEL END-COATING |
|---|---|---|---|
| Percent in resistivity change due to Heat Aging | 1.89% | 0.191% | 0.142% |

The solder preforms 12 provide good electrical contact between the resistor element and the outside leads of the hermetically sealed package. These preforms 12 must provide good wettability to the leads and end terminations of the resistive element 10, 11 when exposed to appropriate temperatures.

The specific sequence of steps for manufacturing the component according to the present invention are suggested in FIG. 4. The refractory metal end-coating 19 is first metallized on both ends of the resistive element 10, 11 by means of sputtering.

The preformed bottles 15 with leads 16 are dropped into correspondingly shaped cavities 28 in a boat 22. The upper open end portion 18 of the bottle extends above the upper surface 23 of the boat 22 for sealing.

A first preform 12, followed by the core 10, followed by a second preform 12 is then inserted into the bottle 15 in the boat 22. The first and second preforms are assembled on a vacuum-locator plate (not shown), which is inverted over the boat 22 with the vacuum holding the preforms over the open end of the bottles 15. The vacuum is then removed, allowing each of the preforms to drop freely into one of the corresponding bottles 15. The cores 10 are assembled on another boat, which is also aligned over the bottles 15 in the boat 22. Each of the cores 10 are then allowed to drop into one of the corresponding bottles 15 in a similar manner.

A heat plate 24 consisting of a plurality of apertures 25 is placed over the boat 22. The other head 14 and terminal lead 13 of the component is then placed in lead-alignment boat 26 which also has correspondingly shaped cavities 28 in corresponding positions corresponding to the cavities 28 in the boat 22. Once the head 14 and lead 13 assemblies are inserted in the boat 26, a removable stainless steel plate (not shown) is placed over the cavities 27 of the boat 26, and the boat 26 is inverted over the heat plate 24.

The removable stainless steel plate now situated between the boat 26 and the heat plate 24 is then removed so as to allow the head 14 to drop by gravity into the bottle 15. The bottle is then sealed at the top end by applying heat to the heat plate 24. The open end 18 of the bottle 15 is thus sealed by glass fusing to the head 14, and the upper or second preform 12 melts thereby forming an electrical connection between the core 10 and the head 14.

In the first embodiment of the invention, the heat from the heat plate 24 is radiated into the lower boat 22 so that the first preform 12 is fused substantially at the same time as the second preform 12. The electrical connection between the core 10 and the lower lead 16 is thus formed substantially at the same time as the connection with the upper head 14. In view of the fact that different amounts of heat may be required to perform these two fusing operations, the first and second preforms 12 may have different heats of fusing.

In a second embodiment of the invention, the assembled components are removed from the lower boat 22 and placed in a furnace or subject to a second heat treatment for fusing the first portion (i.e., fusing the preform to one of the coated ends of the core element, and the first terminal). In this embodiment, the first preform may or may not have the same heat of fusion as the second preform.

While the invention has been illustrated and described as embodied in a Method of Manufacturing A Hermetically Sealed Electronic Component, it is not intended to be limited to the details shown, since various modifications and structural changes may be made without departing in any way from the spirit of the present invention.

Without further analysis, the foregoing will so fully revel the gist of the present invention that others can, by applying current knowledge readily adapt it for various applications without omitting features that, from the standpoint of prior art, fairly constitutes essential characteristics of the generic or specific aspects of this invention and, therefore, such adaptions should and are intended to be comprehended within the meaning and range of equivalence of the following claims.

We claim:

1. A method of manufacturing a hermetically sealed component comprising the steps of:

placing a bottle having an attached first terminal on a closed end in a cavity in a boat;

inserting a first solderable preform in said bottle in said boat;

thereafter introducing a passive electrical core element having ends coated with refractory metal in said bottle;

thereafter introducing a second solderable preform in said bottle;

thereafter introducing a second terminal into said bottle; and sealing said bottle by applying heat to said bottle around said second terminal.

2. The method as defined in claim 1, further comprising the step of fusing said second solderable preform to one of said coated ends of said electrical core element and said second terminal simultaneously with said sealing step.

3. The method as defined in claim 2, further comprising the step of fusing said first solderable preform to one of said coated ends of said electrical core element and said first terminal substantially simultaneously with said sealing step.

4. The method as defined in claim 2, further comprising the step of subsequently fusing said first solderable preform to one of said coated ends of said electrical core element and said first terminal.

5. A method of manufacturing a hermetically sealed passive electrical device comprising the steps of:

coating the surface of an electrical resistor core element with a resistive metal film and forming terminals at opposed ends;

coating said terminals with a refractory metal coating by sputtering;

surrounding said device with a hermetically sealable enclosure, having leads connectable with said terminals;

inserting a solderable preform against said device for making electrical and mechanical connection between one of said leads and a corresponding one of said terminals;

fusing said one lead to said corresponding one of said terminals by melting said solderable preform; and sealing said enclosure simultaneously with said fusing step.

6. The method as defined in claim 5, wherein said refractory metal coating comprises nickel.

7. The method as defined in claim 5, wherein said refractory metal coating comprises cobalt.

8. The method as defined in claim 5, wherein said refractory metal coating comprises chrome.

9. The method as defined in claim 5, wherein said refractory metal coating comprises molybdenum.

10. The method as defined in claim 5, wherein said refractory metal coating comprises tungsten.

11. The method as defined in claim 5, wherein said refractory metal coating comprises tantalum.

12. The method as defined in claim 5, wherein said refractory metal coating comprises titanium.

13. The method as defined in claim 5, wherein said refractory metal coating comprises aluminum.

14. A method of manufacturing a plurality of hermetically sealed passive electrical devices, comprising the steps of:

coating the surface of a plurality of electrical resistor core elements with a resistive film and forming terminals at opposed ends of each of said core elements;

coating said terminals of each of said core elements with a refractory metal coating by sputtering;

substantially simultaneously surrounding each of said plurality of said devices with a hermetically sealable enclosure, each of said enclosures having leads connectable with respective ones of said terminals of said device;

substantially simultaneously inserting a solderable preform against each of said plurality of said devices for making electrical and mechanical connection between each one of said leads and each corresponding one of said terminals;

substantially simultaneously fusing each one of said leads with each corresponding one of said terminals by melting said corresponding solderable preform; and substantially simultaneously sealing each of said enclosures.

* * * * *